US005951055A

United States Patent [19]

Mowry, Jr.

[11] Patent Number: 5,951,055

[45] Date of Patent: Sep. 14, 1999

[54] SECURITY DOCUMENT CONTAINING ENCODED DATA BLOCK

[75] Inventor: William H. Mowry, Jr., Dayton, Ohio

[73] Assignee: The Standard Register Company, Dayton, Ohio

[21] Appl. No.: 08/872,883

[22] Filed: Jun. 11, 1997

Related U.S. Application Data

[51] Int. Cl.[6] ..... B42D 15/00

[52] U.S. Cl. ..... 283/93; 283/72

[58] Field of Search ..... 283/72, 57, 58, 283/93, 114, 901, 17, 73, 74

[56] References Cited

U.S. PATENT DOCUMENTS

| | | | |
|---|---|---|---|
| 5,091,966 | 2/1992 | Bloomberg et al. | 382/21 |
| 5,128,525 | 7/1992 | Stearns et al. | 235/454 |
| 5,131,049 | 7/1992 | Bloomberg et al. | 382/9 |
| 5,157,726 | 10/1992 | Merkle et al. | 380/23 |
| 5,168,147 | 12/1992 | Bloomberg | 235/456 |
| 5,291,243 | 3/1994 | Heckman et al. | 355/201 |
| 5,315,098 | 5/1994 | Tow | 235/494 |
| 5,436,974 | 7/1995 | Kovanen | 380/51 |
| 5,611,575 | 3/1997 | Petrie | 283/67 |

FOREIGN PATENT DOCUMENTS

| | | |
|---|---|---|
| 0 493 053 A2 | 1/1992 | European Pat. Off. . |
| 0 469 868 A2 | 5/1992 | European Pat. Off. . |

OTHER PUBLICATIONS

Article from *The Adams Chronicle,* "CSPI Increases R & D", Nov. 15, 1995 pp. 8–9.

Article from *Today's News,* Xerox Expands Lasertechnics Access to Security Software; Banking and Medical Cards Key Applications for Biometric Security, pp. 1–2.

*Primary Examiner*—Willmon Fridie, Jr.

*Attorney, Agent, or Firm*—Killworth, Gottman, Hagan, Schaeff, LLP

[57] ABSTRACT

A security document is provided comprising human readable transaction data, a plurality of security image elements, a plurality of complementary security image elements, and an encoded information block comprising a plurality of digital glyphs printed thereon. The human readable transaction data printed on the top surface of the substrate forms a full tone image and includes an enhanced security data item. The security image elements printed on the top surface of the substrate and the plurality of complementary security image elements printed on the top surface of the substrate define a security image. The encoded information block comprises a plurality of digital glyphs printed on the top surface of the substrate and comprises encoded transaction data corresponding to at least a portion of the human readable transaction data. The digital glyphs are printed on the top surface of the substrate to form less than a full tone image and the encoded transaction data is positioned proximate the enhanced security data item such that any alteration to the enhanced security data item results in inadvertent alteration to the encoded transaction data.

14 Claims, 6 Drawing Sheets

SECURITY DOCUMENT CONTAINING ENCODED DATA BLOCK

BACKGROUND OF THE INVENTION

The invention is directed towards an improved security document and, more particularly, to a security document containing machine readable code.

Color photocopiers have been used for years to make accurate copies of commonly available documents. In many cases, there are legitimate reasons for making such copies. Unfortunately, color copies may also be made and used for illegal purposes. Specifically, there has been concern that color copiers could be used to reproduce security documents, such as checks, stock certificates, automobile title instruments, birth certificates, college transcripts, prescriptions, and other documents of value, for illegal purposes. This concern has been heightened with the advent of desk top publishing software and hardware, including personal computers and scanners. Such desk top publishing systems allow sophisticated image processing and printing not previously generally available.

Many techniques have been developed to prevent improper reproduction of security documents. One of the most successful is the use of a hidden warning message which is readily apparent on reproduced copies of a document, but which is invisible, or nearly so, on the original document.

Many techniques have been used to produce this effect. One technique is shown in U.S. Pat. No. 4,227,720. A single tone warning phrase and a single tone background pattern are used. Tone refers to the visual effect produced by solid ink coverage or by halftone dots, bars, or marks which cover a portion of a printed area and which usually have a frequency that is measured in dots, lines, or marks per inch. Halftone dots, bars, or marks printed with a dark ink may be more or less uniformly distributed over an area to produce the visual effect of a lighter overall color. Printing an image with less than full area coverage is said to be printing less than a full tone image. The warning phrase and background pattern area tones are of different frequency and are made up of dots, bars, or marks of differing size, but they are selected to provide similar appearance to the eye of a casual observer. A less than full tone effect may also be produced by full area coverage of a paler color of ink than the darker color of ink used for the halftone dots, bars, or marks.

Because the tone of the warning phrase and the tone of the background pattern are selected to be generally the same, these two areas have much the same visual impact on an observer of the original document, and the warning phrase is not readily perceived. The optics of color copiers have typically been unable to reproduce relatively small halftone dots, lines or other elements. As a consequence, reproduced copies of the original document will have a noticeable warning phrase.

A camouflage pattern is sometimes utilized to obscure the warning phrase further. The camouflage pattern may be defined by areas in which the individual dots, bars, or marks have been completely or partially deleted from both the warning phrase and the background pattern. The camouflage pattern may also be defined by a pattern of dots, bars, or marks which are smaller than or larger than those used in the background pattern and the warning phrase, or by areas of complete coverage of a paler ink. The camouflage pattern may permit the tone of the warning phrase and the tone of the background pattern to differ somewhat, while confusing the eye of the casual observer so that the warning phrase is not readily apparent.

The U.S. Pat. No. 4,227,720 patent uses small dots as background elements while larger dots are used to form a warning word. Other patents have used different elements to achieve a similar effect. U.S. Pat. No. 4,891,666 uses small dots as background elements and line segments to form a warning word. U.S. Pat. No. 5,375,886, on the other hand, uses curved lines as background elements and small dots to form the warning word. Another technique is shown in UK Patent Application GB 2,018,197 A. In this published application, line segments are used both as background elements and as warning word elements. The lines are perpendicular to each other in the areas defining the background pattern and the warning phrase.

In recent years, color copiers have been improved substantially. These new color copiers have made the above techniques less effective in protecting documents. By manipulating the control settings on such copiers, copies can be made of such documents in which the warning phrase does not appear on reproductions when some of the most commonly used frequency and size combinations are used. For example, by adjusting the settings for sharpness and lightness/darkness it has still been possible on some copiers for a skilled individual to produce a copy in which the warning phrase is not visible. Furthermore, desk top publishing systems now available in conjunction with laser printers, offer additional possibilities for unauthorized copying.

Therefore, there remains a need in the art for a security document which provides improved protection against copying over a wide range of copier settings, or against manipulation using desk top publishing systems.

SUMMARY OF THE INVENTION

This need is met by the present invention whereby an improved security document is provided. Machine-readable data is encoded in a data block, e.g., a block of digital glyphs, a bar code, a block of characters, etc, and the machine readable code is typically embedded in a conventional "VOID" pantograph or other hidden security image. This results in an improved security document because any attempt at counterfeiting must duplicate two different security measures. Therefore, if the security image is rendered ineffective due to the copier settings or the orientation of the document on the copier, the data block may still provide security protection.

According to one embodiment of the present invention, a security document is provided comprising human readable transaction data, a plurality of security image elements, a plurality of complementary security image elements, and an encoded information block printed thereon. The human readable transaction data printed on the top surface of the substrate forms a full tone image and includes an enhanced security data item, e.g., amount, payee name, date, etc. The security image elements printed on the top surface of the substrate, and the plurality of complementary security image elements printed on the top surface of the substrate, define a security image, e.g. a security term, icon, character, shape, etc. The encoded information block may comprise a plurality of digital glyphs embodying encoded transaction data corresponding to at least a portion of the human readable transaction data. The digital glyphs are printed on the top surface of the substrate to form less than a full tone image and the encoded transaction data is positioned proximate the enhanced security data item such that any alteration to the enhanced security data item results in inadvertent alteration to the encoded transaction data.

According to another embodiment of the present invention, a security document is provided comprising a substrate including a top surface for carrying printed indicia, a plurality of security image elements printed on the top surface of the substrate, and a plurality of complementary security image elements printed on the top surface of the substrate. The security image elements and the complementary security image elements define a security image and the complementary security image elements define an encoded information block comprising a plurality of information bearing elements. Alternatively, the security image elements may define the encoded information block comprising the information bearing elements. As a further alternative, the security image elements and the complementary security image elements may define the encoded information block comprising the information bearing elements.

According to yet another embodiment of the present invention, a security document is provided comprising: a substrate including a top surface for carrying printed indicia; human readable transaction data printed on the top surface of the substrate; a plurality of security image elements printed on the top surface of the substrate; and, a plurality of complementary security image elements printed on the top surface of the substrate. The security image elements and the complementary security image elements define a security image. The complementary security image elements define an encoded information block comprising a plurality of information bearing elements. The encoded information block comprises encoded transaction data corresponding to at least a portion of the human readable transaction data. The human readable transaction data may include static transaction data and variable transaction data and the encoded information block may include a first set of information bearing elements corresponding to the static transaction data and a second set of information bearing elements corresponding to the variable transaction data.

According to yet another embodiment of the present invention, a security document is provided comprising a substrate including a top surface for carrying printed indicia; human readable transaction data printed on the top surface of the substrate; a plurality of security image elements printed on the top surface of the substrate; and, a plurality of complementary security image elements printed on the top surface of the substrate. The security image elements and the complementary security image elements define a security image. An encoded information block is printed on the top surface of the substrate, wherein the encoded information block comprises encoded transaction data corresponding to at least a portion of the human readable transaction data.

The human readable transaction data may include an enhanced security data item, e.g. amount, payee name, date, etc. The encoded information block may comprise encoded transaction data corresponding to the enhanced security data item and the encoded transaction data may be positioned proximate the enhanced security data item such that any alteration to the enhanced security data item results in inadvertent alteration to the encoded transaction data. Specifically, the human readable transaction data may include an amount, the encoded information block may comprise encoded transaction data corresponding to the amount, and the encoded transaction data may be positioned proximate the amount such that any alteration to the amount results in inadvertent alteration to the encoded transaction data.

Further, the human readable transaction data may include an amount including digits defining a physical amount outline, the encoded information block may comprise encoded transaction data corresponding to the amount, and the encoded transaction data may surround the physical amount outline. Further still, the human readable transaction data may include an amount, the encoded information block may comprise encoded transaction data corresponding to the amount, and the encoded transaction data may form a background over which the amount is printed. As a final example, the human readable transaction data may include an amount including digits defining interior digit space, the encoded information block may comprise encoded transaction data corresponding to the amount, and the encoded transaction data may be printed in the interior digit space.

According to yet another embodiment of the present invention, a security document is provided comprising a substrate including a top surface for carrying printed indicia; human readable transaction data printed on the top surface of the substrate; a plurality of security image elements printed on the top surface of the substrate; a plurality of complementary security image elements printed on the top surface of the substrate; and, an encoded information block comprising a plurality of digital glyphs printed on the top surface of the substrate. The security image elements and the complementary security image elements define a security image.

The plurality of digital glyphs may form at least a portion of the plurality of complementary security image elements. The human readable transaction data may be printed on the top surface of the substrate to form a full tone image and the plurality of digital glyphs may be printed on the top surface of the substrate to form less than a full tone image.

Accordingly, it is an object of the present invention to provide an improved security document in which both machine-readable data and a hidden security image are present on the surface of the document. Other objects and advantages of the invention will be apparent from the following description, the accompanying drawings and the appended claims.

DETAILED DESCRIPTION OF THE PREFERRED EMBODIMENTS

The present invention is an improvement over past security documents in that it provides two types of security protection, a hidden security image and a machine-readable data block, on one document. The two types of security protection are both sensitive to copier settings. Specifically, the hidden security image, which may comprise a "VOID" pantograph or another security term, icon, character, or shape, becomes apparent on the face of a photocopy of the document. Similarly, the machine readable data block is designed, i.e., shaped, sized, and oriented, such that its image is distorted in the process of photocopying or scanning, manipulating, and printing the document image.

The result is an improved security document embodying two distinct security features. If, in attempting to copy the security document of the present invention, the hidden security image is rendered ineffective due to specific manipulation of copier settings or the orientation of the document on the copier, the machine-readable data block is likely to be degraded and unreadable, invalidating the copy. For the purposes of defining and describing the present invention, the term "document" shall mean any tangible object upon which information is printed, e.g., a sheet of paper, a card, a label, etc.

In the past, many systems have been used to protect documents from illicit copying and/or copying with alterations that produce pseudo originals to substitute for genuine documents. These systems have depended on copiers providing differential reproduction of different portions of the original image. The person examining the document must judge the authenticity based on various clues. In many cases, the word "VOID" stands out on the copy but is suitably hidden on the original. In these previous systems, the determination of authenticity was not based on, or assisted by, a machine reader.

The present invention utilizes information in digital glyphs to provide an additional, machine readable, means of authenticating a security document. Digital glyphs, the related basic code, and various related decoding processes are known in the art and taught in U.S. Pat. Nos. 5,291,243, 5,091,966, 5,128,55, and 5,168,147, the disclosures of which are incorporated herein by reference. Digital glyphs provide a means for storing highly reliable, machine readable information on the face of documents. This information can be used to duplicate human readable information on a document in machine readable form. Glyph characters according to the present invention are designed to be printed by 300 dpi (dots per inch) and 600 dpi non-impact printers or other printing devices of comparable or superior resolution. The data embodied in the digital glyphs can be recaptured and decoded by a suitable scanner and computer equipped with appropriate software.

Figure 2:
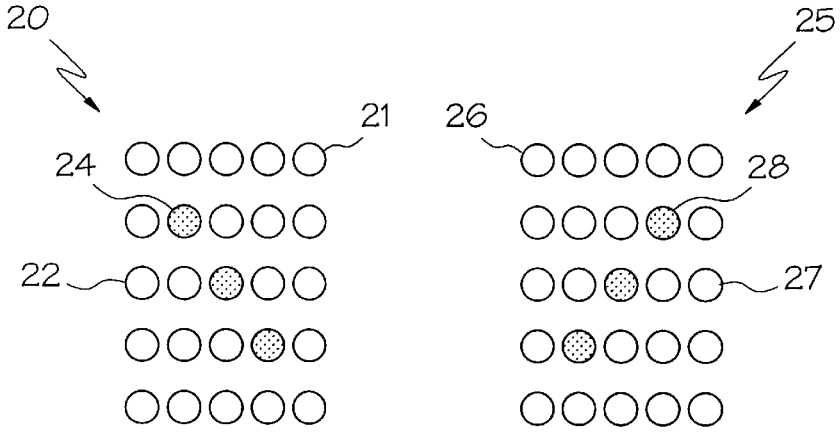
FIG. 2 is an illustration of the pixel patterns used in the data block of the present invention.

In one embodiment of the present invention, two digital glyph characters are formed in a 5×5 matrix of pixels using the central 3×3 area to form the two characters from only three pixels placed in diagonal lines and the remaining six pixels as well as the outer ring of sixteen pixels are rendered as white space (see FIG. 2). The two arrangements of three pixel diagonals are used to represent the 1's and 0's of binary code.

The present invention uses digital glyphs to produce an overall tone in the background of a document that resembles the tint of a conventional VOID pantograph. By one calculation, the tint effect resembles a standard 12% flat tint.

The printed digital glyph image on the original document serves as both an information bearing element and a security element that changes when copied to reveal a security image, e.g. "VOID", and make the copy appear invalid to the unaided human observer during a first level of examination. In other words, one or more "VOID"s appear upon copying per conventional technologies.

It also provides the basis for a machine aided evaluation as either an auxiliary step or as a primary evaluation to determine authenticity. In general, copiers make a hash of the printed halftone dots although they may render the tones convincingly real when viewed by the unaided eye at normal viewing distance. The destruction of the glyph detail provides a further means of copy detection when a suitable scanner and computer equipped with proper software are used to attempt to decode the glyph detail.

Considerable constant information can be included in the printed digital glyph image including bank information, company information, account information, cryptic codes, illustrations, etc. The digital glyph image includes a variety of information at a considerable redundancy to increase the probability of reading the document even though there has been a fair amount of damage to the original document. A copy of the document will not accurately reproduce the glyph characters, making it nearly unintelligible to a machine reader.

Suitably equipped issuing machines can add digital glyphs in selected areas of a document to provide machine readable data corresponding to the human readable information provided on the document, e.g. payee, amount, transaction site, date, transaction number, etc. To successfully alter the document, alterations must be made to the human readable information and to the glyphs; otherwise, a mismatch between the machine readable information and the human readable information will indicate alteration of the document. Further, actions to alter the human readable information may disrupt the glyphs enough to generate warnings.

The construction of a suitably encoded document on desk top publishing devices is also more difficult where digital glyph encoded security documents are used. This is especially true for closed systems that may use proprietary glyph codes for issuing and reading the documents.

Glyphs encoding static information, and glyphs encoding variable information may be used in combination on a single document. The combination of static and variable information makes a document uniquely secure from both alteration and counterfeiting. Encoding strings are generated and applied by the issuing machinery during the transaction to permit later reading and capture of the intended transaction.

In addition, by mixing 300 dpi and 600 dpi marks, a document embodying a 60 line per inch screen for a VOID word and a 120 line per inch screen for a background can be constructed. By constructing the screens from information bearing strings of glyphs, the basic document can be described in machine readable form. Further, upon copying, the document will also give a human readable warning, e.g. VOID. Copying will also degrade the digital glyph characters, providing an additional means for confirming lack of authenticity.

The ability to issue documents bearing codes that describe the individual transactions extends the concept that is now used for placing the amount in words in its unique area along with the amount in specially designed numbers to make alteration more difficult. Adding the information in glyphs placed in their own assigned area, preferably behind the human readable numbers and words, gives an additional and sophisticated level of protection.

Figure 1:
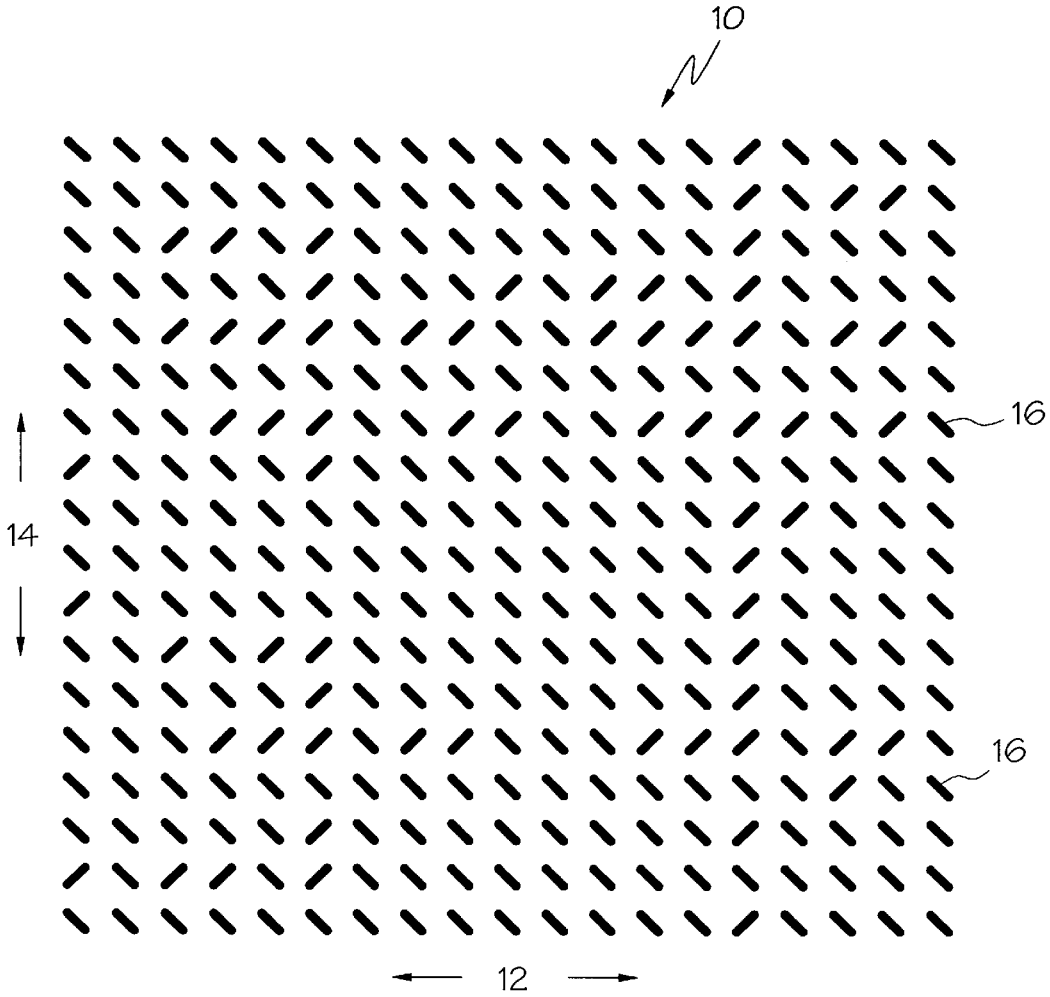
FIG. 1 is an illustration of a data block useful in the present invention.

Reference is made to FIG. 1, which illustrates an encoded information block 10 having a horizontal axis 12 and a vertical axis 14. The information block 10 contains a plurality of information bearing elements 16. The information bearing elements 16 are line-shaped digital glyphs and each element is oriented at either a 45 degree angle to the horizontal axis 12 of the information block 10 or a 135 degree angle to the horizontal axis 12. The encoded information block 10 comprises a repeating data string which, as will be appreciated by those skilled in the art, corresponds to predetermined information specific to the particular use of the information block.

FIG. 2 illustrates the pixel patterns of the information bearing elements 16 or digital glyphs. Two patterns are shown. The first pattern 20 contains 25 pixel areas 21. The hollow circles 22 represent white paper (areas without ink), while the solid circles 24 represent ink spots. The first pattern 20 demonstrates a pixel pattern in which the ink spots are arranged in a diagonal line. The diagonal line is oriented at about a 135 degree angle to the horizontal axis of the pattern. This represents a first possible arrangement of ink spots. The second pattern 25 contains pixel areas 26. This pattern also has hollow circles 27, which represent white paper, and solid circles 28, which represent ink spots. The second pattern 25 demonstrates a pixel pattern in which the ink spots are also arranged in a diagonal line. In this pattern, the diagonal line is oriented at about a 45 degree angle to the horizontal axis of the pattern. This represents a second possible arrangement of ink spots. It is contemplated by the present invention that other ink spot arrangements may be created utilizing the pixel areas 21, 26 of the present invention.

Figure 3:
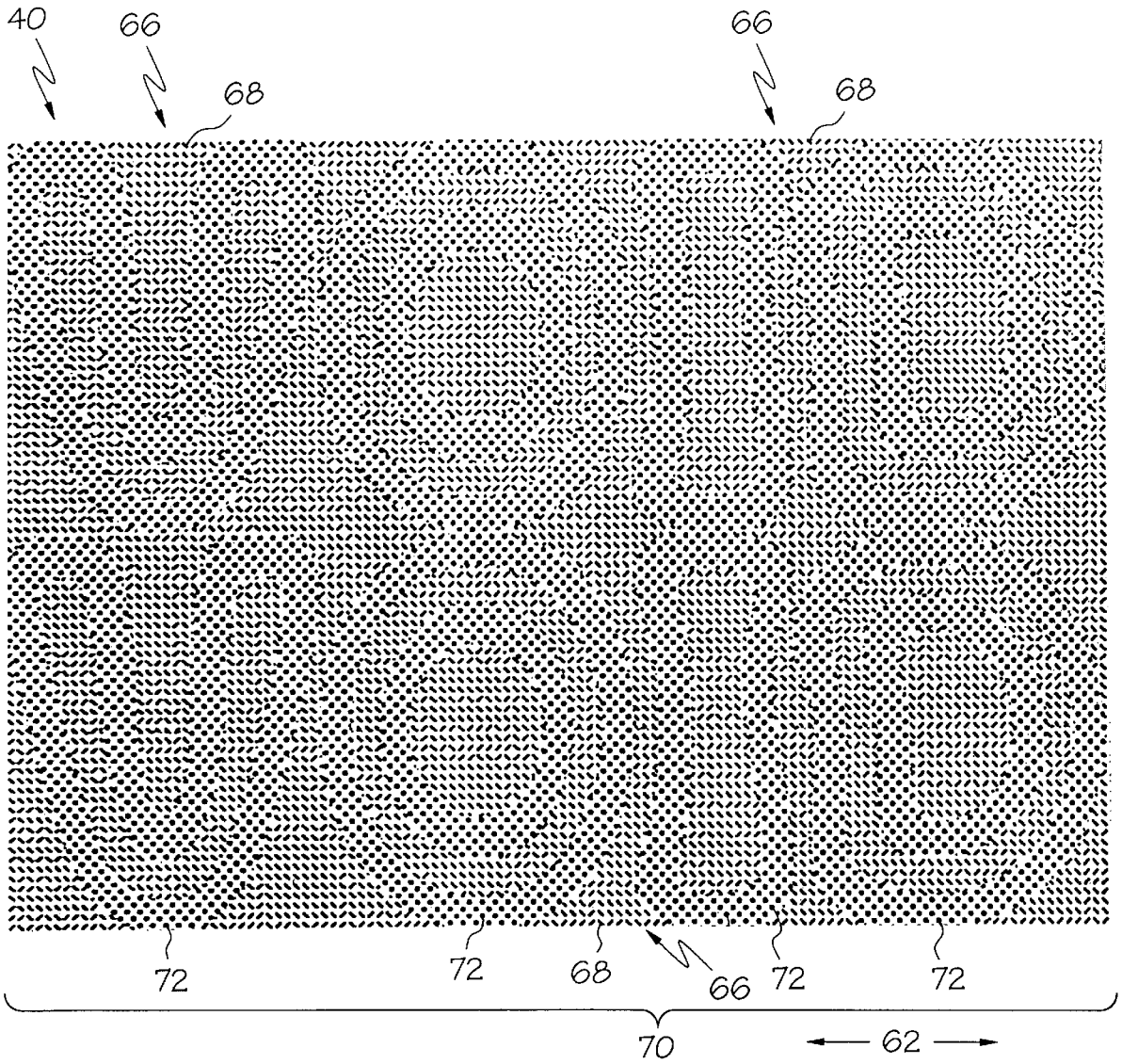
FIGS. 3–7 illustrate security documents according to the present invention.

In FIG. 3 a security document 40 having a horizontal axis 62 and a vertical axis 64 is shown. It is noted that the human readable information typically found on security documents is not included in the security documents illustrated in FIGS. 3–6 to enable clear description of the present invention. The security document 40 includes an information block 66 containing a plurality of information bearing elements 68 or digital glyphs. The security document 40 also contains security images 70 composed of security image elements 72, indicating the word "VOID." The information bearing elements 68 function as complementary security image elements in that they are not readily reproducible by a photocopier in conjunction with the security image elements 72. Accordingly, when the security document 40 including the security image elements 72 and the information bearing elements 68 is photocopied, an image defined by the placement of either the security image elements 72 or the complementary security image elements, e.g. "VOID," becomes prominent on the document. For example, the security image elements 72 may comprise relatively large half tone dots and the information bearing elements 68 may comprise relatively small half tone dots, as will be appreciated by one skilled in the art.

For the purposes of describing and defining the present invention a security image element shall be any printed element which is designed so as not to be readily reproducible by a photocopier, e.g., a digital or color copier, in conjunction with a complementary security image element. For example, the large dots and small dots which form the void pantograph described in U.S. Pat. No. 4,227,720 comprise security image elements and complementary security image elements because their relative sizes are selected such that, when a document containing both types of elements is photocopied, only one of the types of elements is readily or clearly reproduced.

Figure 4:
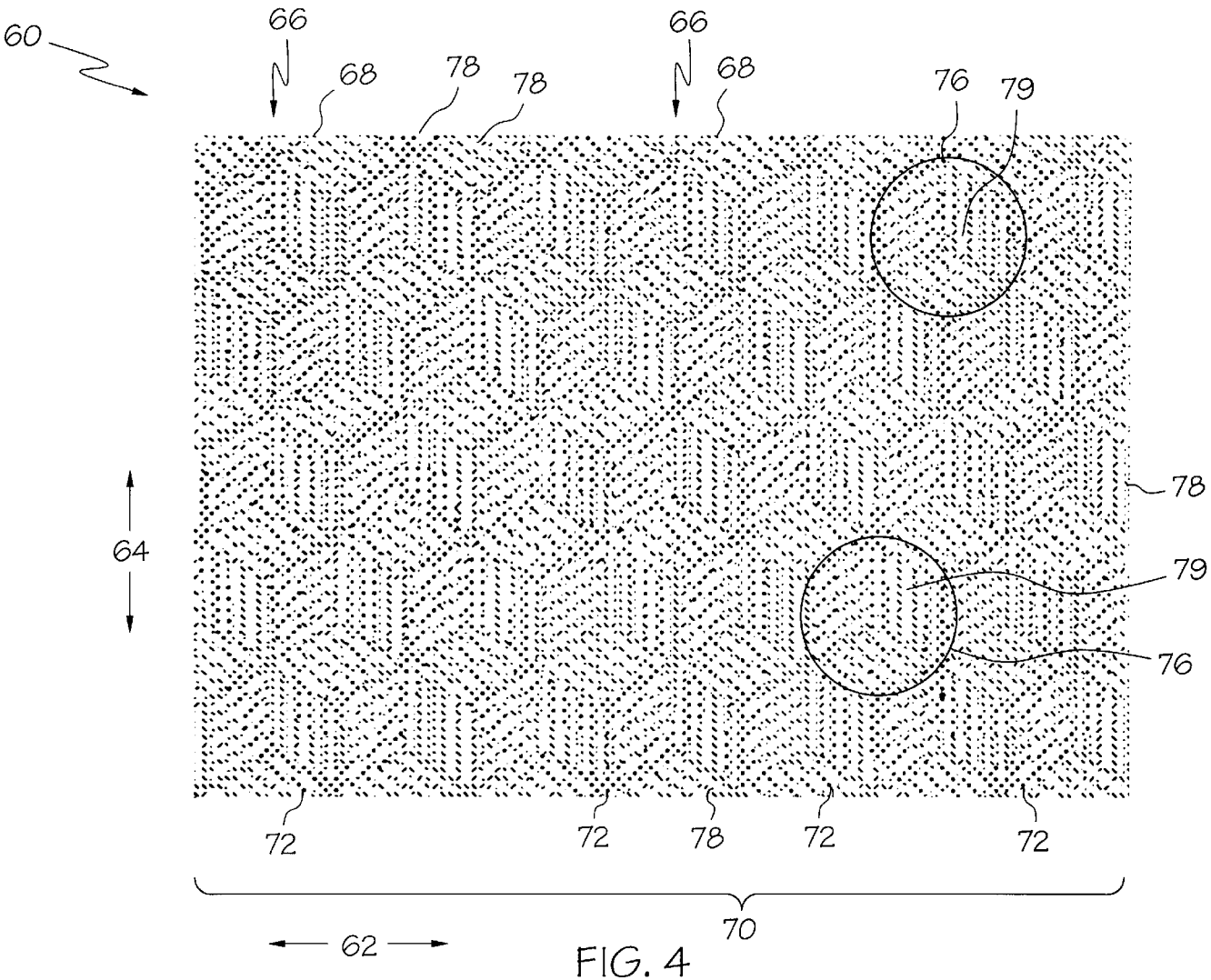

Referring now to FIG. 4, an alternative security document 60 is illustrated wherein, in addition to the security image elements 72 and the information bearing elements 68 illustrated in FIG. 3, the security document 60 contains complementary security image elements 78 and voids 79. The voids 79 define camouflage image elements 76 of a crossweave camouflage image 76. The complementary security image elements 78 comprise elements which are not readily reproducible by a photocopier in conjunction with the security image elements 72. Accordingly, when a security document including the security image elements 72 and the complementary security image elements 78 is photocopied, an image defined by the placement of either the security image elements 72 or the complementary security image elements 78 becomes prominent on the document. For example, the security image elements 72 may comprise relatively large half tone dots and the complementary security image elements 78 may comprise relatively small half tone dots, as will be appreciated by one skilled in the art. It is contemplated by the present invention that, as will be appreciated by those skilled in the art, a variety of security image elements and complementary security image elements may be utilized to render the security image prominent on the face of the document 60 upon photocopying.

In each security document 40, 60, the encoded information block 66 comprises information bearing elements 68 in the form of digital glyphs oriented at either a 45 degree angle to the horizontal axis 62 of the security document 40, 60 or a 135 degree angle to the horizontal axis 62 of the security document 40, 60. The information bearing elements 68 define an encoded information block 66 comprising a plurality of information bearing elements 68.

Figure 5:
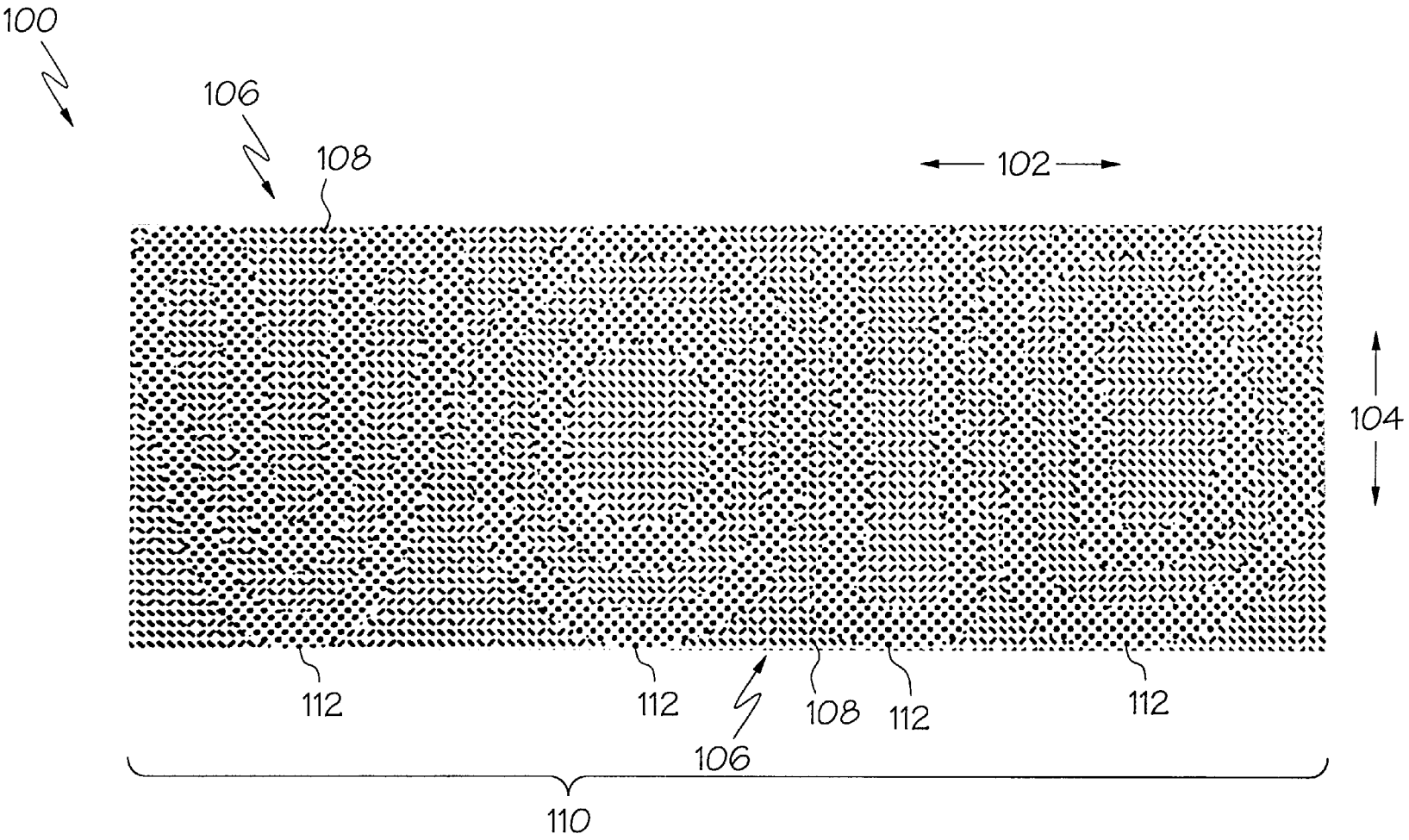

In FIG. 5, a security document 100 having a horizontal axis 102 and a vertical axis 104 is shown. The security document 100 includes an information block 106 containing a plurality of information bearing elements 108 or digital glyphs. The security document 100 also contains a security image 110 composed of security image elements 112, indicating the word "VOID." The information bearing elements 108 function as complementary security image elements in that they are not readily reproducible by a photocopier in conjunction with the security image elements 112. Accordingly, when the security document 100 including the security image elements 112 and the information bearing elements 108 is photocopied, an image defined by the placement of either the security image elements 112 or the complementary security image elements, e.g. "VOID," becomes prominent on the document 100. For example, the security image elements 112 may comprise relatively large half tone dots and the information bearing elements 108 may comprise relatively small half tone dots, as will be appreciated by one skilled in the art.

Figure 6:
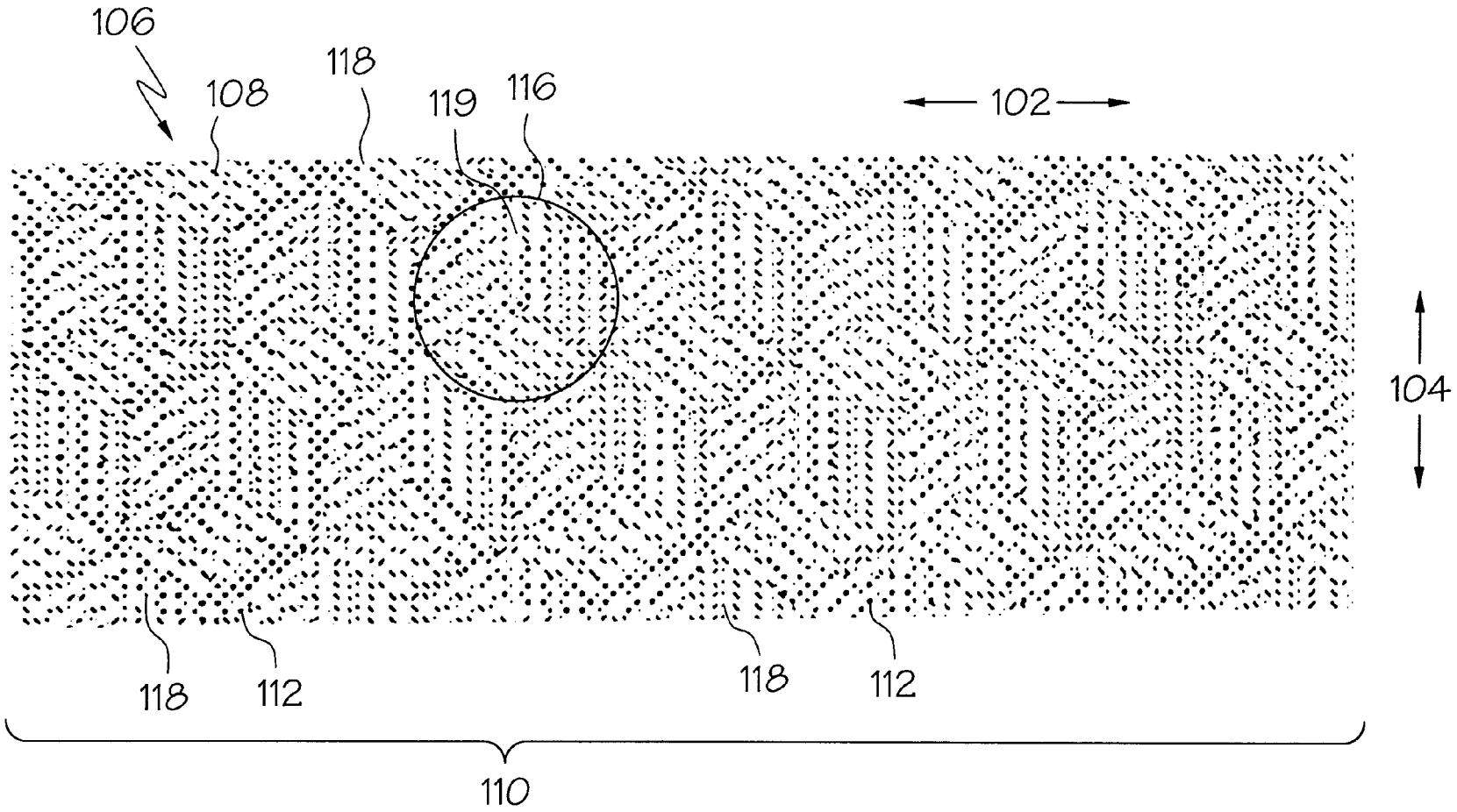

Referring now to FIG. 6, an alternative security document 110 is illustrated wherein, in addition to the security image elements 112 and the information bearing elements 108 illustrated in FIG. 3, the security document 110 contains complementary security image elements 118 and voids 119. The voids 119 define camouflage image elements 116 of a crossweave camouflage image. The complementary security image elements 118 comprise elements which are not readily reproducible by a photocopier in conjunction with the security image elements 112. Accordingly, when a security document including the security image elements 112 and the complementary security image elements 118 is photocopied, an image defined by the placement of either the security image elements 112 or the complementary security image elements 118 becomes prominent on the document 110. For example, the security image elements 112 may comprise relatively large half tone dots and the complementary security image elements 118 may comprise relatively small half tone dots, as will be appreciated by one skilled in the art. It is contemplated by the present invention that, as will be appreciated by those skilled in the art, a variety of security image elements and complementary security image elements may be utilized to render the security image prominent on the face of the document 110 upon photocopying.

Specifically, it is contemplated by the present invention that security images may comprise geometrically shaped dots (both large dots and small dots), line segments, triangles, rectangles, curves, swirls, or other geometric shapes. Examples of various relationships between the security image elements and the complementary security image elements include:

| Security Image Elements | Complimentary Image Elements |
|---|---|
| Large dot | Small dot |
| Small dot | Large dot |
| Line segment | Small dot |
| Line segment | Large dot |
| Small dot | Line segment |
| Large dot | Line segment |
| Line segment | Line segment |

The rows of small dots and large dots may be oriented in the same direction. The line segments may be oriented in the same direction as the rows of large or small dots. Alternatively, the line segments may be oriented at a different angle than the rows of dots. A preferred angle is 90 degrees. When the security image is composed of line segments, the line segments of one set of elements will be at a different angle than the line segments of the other set of elements. A preferred angle is 90 degrees.

The frequencies of each element may be the same or different. If the frequencies are different, it is preferred, but not required, that one set of elements be spaced at twice the frequency of the other set of elements. For instance, one useful combination is 130 lines per inch for the security image elements and 65 lines per inch for the complementary elements. Another useful combination is 120 lines per inch for the security image elements and 60 lines per inch for the complementary elements.

The density of the security image elements and the complementary security image elements on the surface of the document may vary from 3% coverage to 50% coverage. Preferably, densities of 10 to 15 percent are used. The density of the complementary elements and the density of the security image elements within a copy bloc may be the same, or the densities may differ. Preferably, difference in the density is small to reduce the likelihood that the security image will be noticed. For example, one useful combination would be a density of 15% for the security image elements and 10% for the complementary elements. If desired, a camouflage image may be used to make security images less apparent on the original security document.

Elements shaped as line segments will have an angular orientation with respect to the security document. Preferably, line segments are oriented at 0, 15, 30, 45, 60, 75, 90, 105, 120, 135, 150, or 165 degrees to the horizontal axis of the security document, but any angular orientation may be used.

According to one aspect of the present invention, the encoded information block 66 comprises encoded transaction data corresponding to at least a portion of the human readable transaction data printed on the security document 40, 60. For example, with reference to FIG. 7, human readable transaction data comprises a transaction date 51, a document name 52, payee 53, amount 54, etc, and the encoded information block 66 embodies encoded transaction data corresponding to at least one of the transaction date 51, document name 52, payee 53, and amount 54.

Figure 7:
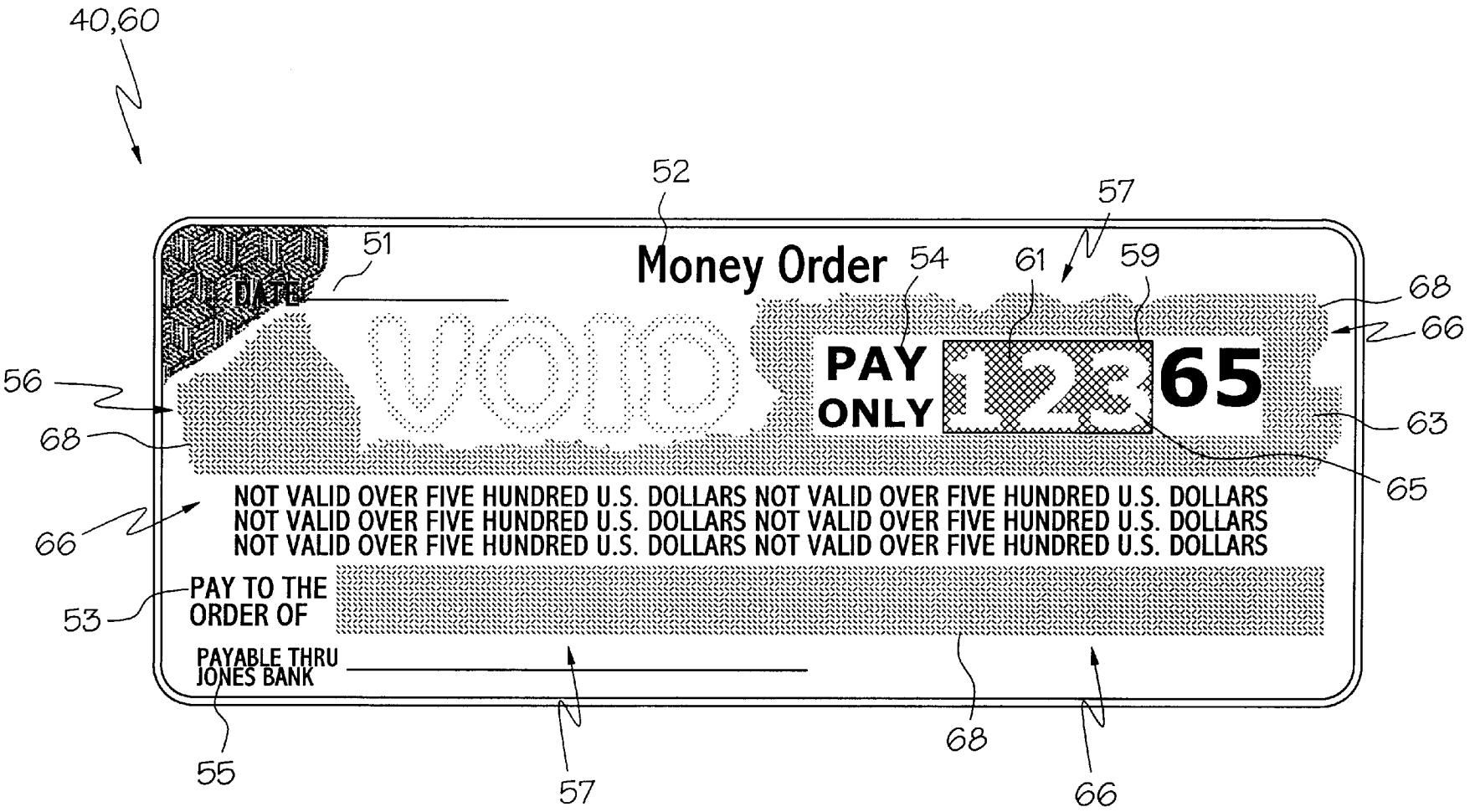

According to another aspect of the present invention, with further reference to FIG. 7, the human readable transaction data includes static transaction data, e.g., bank name 55, document name 52, etc., and variable transaction data, e.g., payee 53, amount 54, etc. The encoded information block 66 includes a first set 56 of information bearing elements 68 corresponding to the static transaction data, e.g., the bank name 55 and the document name 52, and a second set 57 of information bearing elements 68 corresponding to the variable transaction data, e.g., the payee 53 and the amount 54. The second set of 57 of information bearing elements 68 may include separate subgroups of information bearing elements 68 each positioned proximate separate types of variable transaction data, e.g, amount and payee.

According to another aspect of the present invention, the human readable transaction data includes an enhanced security data item, e.g., the amount or the payee, and the encoded information block 66 defining the encoded transaction data is positioned proximate the enhanced security data item such that any alteration to the enhanced security data item results in inadvertent alteration to the encoded transaction data. For example, referring to FIG. 7, the human readable transaction data includes the amount 54, the encoded information block 66 comprises encoded transaction data corresponding to the amount 54, and the encoded transaction data is positioned proximate the amount in proximate amount area 59, surrounding a physical outline 61 of the amount, as a background 63 over which the amount is printed, or printed in an interior digit space 65 of the amount. In this manner, an attempt to alter the enhanced security data item will degrade or destroy the encoded information block 66. A subsequent attempt to read or decode the information block 66 during validation will indicate alteration. Further, because the information block is machine readable, as opposed to human readable, persons attempting alterations will be less likely to realize that incidental alteration of the information block 66 will indicate alteration.

The security document according to the present invention contains at least one security image. The security image may take the form of a single warning word, such as "VOID." Alternatively, the security image may be in the form of multiple warning words. In another alternative, the security image may form part of a large warning word covering multiple copy blocs. These various alternatives allow for placement of warning messages of a broad range of sizes anywhere on the surface of the security document.

The tone of the security document may be a uniform tone over the document surface. In this embodiment, the density of the document may have different values for the security image elements and the complementary elements, but the field will appear constant. Alternatively, the surface of the security document may use a graded screen. In this embodiment, for example, the frequencies of the complementary elements and the security image elements remain the same, while the size of the elements is varied across the document. As an example, the frequency might be 130 lines per inch and 65 lines per inch for the complementary elements and the security image elements, respectively. The size of the complementary elements may vary across the document so that the density varies from 30% of the area covered to 3%, and the size of the security image elements may vary across the document so that the density varies from 49% to 4% of the area covered. For example, the highest percentages of coverage may be at the top of the security document. These percentages are then gradually reduced toward the bottom of the document. This change in coverage percentages may occur in steps, producing bands of slightly differing tone. If desired, however, the size of the elements or the frequency of the elements, or both, may be continuously varied over the document surface. Regardless of the manner in which the size of the complementary elements and the size of the security image elements are varied, the selection of element sizes for a given area on the document is made such that they provide generally equal tone. The tones may differ more if a camouflage image is used.

It should be understood that the phrase "security image" is intended to include not only words, such as the word "VOID" shown in the drawings, but also symbols, words, and phrases which simply make evident to an observer that the document being inspected is a copy of the original document. Such phrases as "PHOTOCOPY", "COPY", and "DUPLICATE" may be used for this purpose.

It should be understood that any of a wide variety of camouflage images may be utilized to disguise the security image on a security document according to the present invention. For a camouflage to be effective, the camouflage image usually occupies about 50% of the document surface area. A properly configured camouflage image becomes the dominant image in the eye of the casual observer. A camouflage image may be defined by the absence of elements within the image area or by the presence of further printed elements.

"Complementary security image elements," as referenced herein and in the appended claims, comprise elements printed on the face of a document which are not readily reproducible by a copier in conjunction with accompanying security image elements also present on the face of a document. It should be appreciated that the phrase "readily reproducible" defines objects which are capable of being clearly reproduced without significant blurring of their image.

It is contemplated by the present invention that the encoded information block of the present invention may be made up of information bearing elements other than digital glyphs, e.g., a bar code, a block of characters, etc., provided the elements are arranged or structured such that the information encoded therein is not readily recognizable by the unaided human eye.

Having described the improved security document of the present invention in detail and by reference to different embodiments thereof, it will be apparent that certain modifications and variations are possible without departing from the scope of the invention defined in the appended claims.

What is claimed is:

1. A security document comprising:

a substrate including a top surface for carrying printed indicia;

a plurality of security image elements printed on said top surface of said substrate; and a plurality of information bearing elements defining an encoded information block printed on said top surface of said substrate, wherein said information bearing elements are arranged to function as complementary security image elements such that said security image elements and said complementary security image elements define a security image, and wherein said security image elements and said complementary security image elements defining said security image are arranged such that said security image is not readily perceived on said security document and becomes prominent on an attempted reproduction of said security document.

2. A security document as claimed in claim 1 wherein said encoded information block is further defined by said security image elements.

3. A security document comprising:

a substrate including a top surface for carrying printed indicia;

a plurality of complementary security image elements printed on said top surface of said substrate; and a plurality of information bearing elements defining an encoded information block printed on said top surface of said substrate, wherein said information bearing elements are arranged to function as security image elements such that said security image elements and said complementary security image elements define a security image, and wherein said security image elements and said complementary security image elements defining said security image are arranged such that said security image is not readily perceived on said security document and becomes prominent on an attempted reproduction of said security document.

4. A security document comprising:

a substrate including a top surface for carrying printed indicia;

human readable transaction data printed on said top surface of said substrate; and a plurality of security image elements printed on said top surface of said substrate and a plurality of complementary security image elements printed on said top surface of said substrate, wherein said security image elements and said complementary security image elements define a security image, wherein said complementary security image elements define an encoded information block comprising a plurality of information bearing elements, and wherein said encoded information block comprises encoded transaction data corresponding to at least a portion of said human readable transaction data.

5. A security document as claimed in claim 4 wherein said human readable transaction data includes static transaction data and variable transaction data, and wherein said encoded information block includes a first set of information bearing elements corresponding to said static transaction data and a second set of information bearing elements corresponding to said variable transaction data.

6. A security document comprising:

a substrate including a top surface for carrying printed indicia;

human readable transaction data printed on said top surface of said substrate;

a plurality of security image elements printed on said top surface of said substrate and a plurality of complementary security image elements printed on said top surface of said substrate, wherein said security image elements and said complementary security image elements define a security image; and an encoded information block printed on said top surface of said substrate,wherein said encoded information block comprises encoded transaction data corresponding to at least a portion of said human readable transaction data wherein said human readable transaction data includes an amount, wherein said encoded information block comprises encoded transaction data corresponding to said amount, and wherein said encoded transaction data is positioned proximate said amount such that any alteration to the amount results in inadvertent alteration to the encoded transaction data.

7. A security document comprising:

a substrate including a top surface for carrying printed indicia;

human readable transaction data printed on said top surface of said substrate;

a plurality of security image elements printed on said top surface of said substrate and a plurality of complementary security image elements printed on said top surface of said substrate, wherein said security image elements and said complementary security image elements define a security image; and an encoded information block printed on said top surface of said substrate, wherein said encoded information block comprises encoded transaction data corresponding to at least a portion of said human readable transaction data wherein said human readable transaction data includes an amount, wherein said encoded information block comprises encoded transaction data corresponding to said amount, and wherein said encoded transaction data is positioned proximate said amount such that any alteration to the amount results in inadvertent alteration to the encoded transaction data.

8. A security document comprising:

a substrate including a top surface for carrying printed indicia;

human readable transaction data printed on said top surface of said substrate;

a plurality of security image elements printed on said top surface of said substrate and a plurality of complementary security image elements printed on said top surface of said substrate, wherein said security image elements and said complementary security image elements define a security image; and an encoded information block printed on said top surface of said substrate, wherein said encoded information block comprises encoded transaction data corresponding to at least a portion of said human readable transaction data wherein said human readable transaction data includes an amount including digits defining a physical amount outline, wherein said encoded information block comprises encoded transaction data corresponding to said amount, and wherein said encoded transaction data surrounds said physical amount outline.

9. A security document comprising:

a substrate including a top surface for carrying printed indicia;

human readable transaction data printed on said top surface of said substrate;

a plurality of security image elements printed on said top surface of said substrate and a plurality of complementary security image elements printed on said top surface of said substrate, wherein said security image elements and said complementary security image elements define a security image; and an encoded information block printed on said top surface of said substrate, wherein said encoded information block comprises encoded transaction data corresponding to at least a portion of said human readable transaction data wherein said human readable transaction data includes an amount, wherein said encoded information block comprises encoded transaction data corresponding to said amount, and wherein said encoded transaction data forms a background over which said amount is printed.

10. A security document comprising:

a substrate including a top surface for carrying printed indicia;

human readable transaction data printed on said top surface of said substrate;

a plurality of security image elements printed on said top surface of said substrate and a plurality of complementary security image elements printed on said top surface of said substrate, wherein said security image elements and said complementary security image elements define a security image; and an encoded information block printed on said top surface of said substrate, wherein said encoded information block comprises encoded transaction data corresponding to at least a portion of said human readable transaction data wherein said human readable transaction data includes an amount including digits defining interior digit space, wherein said encoded information block comprises encoded transaction data corresponding to said amount, and wherein said encoded transaction data is printed in said interior digit space.

11. A security document comprising:

a substrate including a top surface for carrying printed indicia;

human readable transaction data printed on said top surface of said substrate to form a full tone image, wherein said human readable transaction data includes an enhanced security data item;

a plurality of security image elements printed on said top surface of said substrate and a plurality of complementary security image elements printed on said top surface of said substrate, wherein said security image elements and said complementary security image elements define a security image; and an encoded information block comprising a plurality of digital glyphs printed on said top surface of said substrate, wherein said encoded information block comprises encoded transaction data corresponding to at least a portion of said human readable transaction data, wherein said plurality of digital glyphs are printed on said top surface of said substrate to form less than a full tone image, and wherein said encoded transaction data is positioned proximate said enhanced security data item such that any alteration to said enhanced security data item results in inadvertent alteration to said encoded transaction data.

12. A security document as claimed in claim 11 wherein said plurality of digital glyphs form at least a portion of said plurality of complementary security image elements.

13. A security document as claimed in claim 11 wherein said plurality of digital glyphs form at least a portion of said plurality of security image elements.

14. A security document comprising:

a substrate including a top surface for carrying printed indicia;

a plurality of security image elements printed on said top surface of said substrate; and a plurality of information bearing elements defining an encoded information block printed on said top surface of said substrate, wherein said information bearing elements are arranged to function as complementary security image elements such that said security image elements and said complementary security image elements define a security image, and wherein said complementary security image elements and said security image elements are arranged such that said complementary security image elements are not readily reproducible in conjunction with said security image elements and such that said security image is not readily perceived on said security document and is rendered visually perceptible on an attempted reproduction of said security document.

* * * * *